US005598855A

United States Patent [19]

Rizzoli et al.

[11] Patent Number: 5,598,855

[45] Date of Patent: Feb. 4, 1997

[54] METHOD AND MACHINE FOR PRODUCING VENTILATED CIGARETTES

[75] Inventors: Salvatore Rizzoli, Bologna; Fiorenzo Draghetti, Medicina, both of Italy

[73] Assignee: G.D Societa' Per Azioni, Bologna, Italy

[21] Appl. No.: 404,639

[22] Filed: Mar. 15, 1995

[30] Foreign Application Priority Data

Mar. 16, 1994 [IT] Italy ..... BO94A0105

[51] Int. Cl.[6] ..... A24C 5/60

[52] U.S. Cl. ..... 131/281; 219/121.71; 219/121.77

[58] Field of Search ..... 131/281; 219/121.6, 219/121.67, 121.72, 121.7, 121.71

[56] References Cited

U.S. PATENT DOCUMENTS

| | | | |
|---|---|---|---|
| 5,148,818 | 9/1992 | Arthur | 131/281 |

FOREIGN PATENT DOCUMENTS

| | | | |
|---|---|---|---|
| 384121 | 8/1990 | European Pat. Off. | 131/281 |
| 2633541A1 | 5/1990 | France . | |
| 4108166A1 | 9/1992 | Germany . | |
| 2119223 | 11/1983 | United Kingdom | 131/281 |
| 2167936 | 11/1986 | United Kingdom . | |
| 2219485 | 12/1989 | United Kingdom | 131/281 |
| 2241866 | 9/1991 | United Kingdom . | |

*Primary Examiner*—Jennifer Bahr
*Attorney, Agent, or Firm*—Marshall, O'Toole, Gerstein, Murray & Borun

[57] ABSTRACT

A method and machine for producing ventilated cigarettes comprises forming a succession of double cigarettes, each comprising two cigarette portions and an intermediate double filter joined by an intermediate connecting band. The double cigarettes are translated to respective double cigarette supporting means on a rotary conveyor having an axis. The supporting means includes a rotatable gondola normally facing outward in relation to the conveyor and rotatable about the axis and rest means fixed in relation to the conveyor. Each double cigarette is arranged in engagement with the respective supporting means so that a first end portion of the double cigarette laterally engages the rotatable gondola. A second end portion of the double cigarette laterally engages the rest means. An intermediate portion of the double cigarette including the intermediate double filter is free. The conveyor is advanced to feed the double cigarettes through a perforating station. At the perforating station, each double cigarette is rotated about its axis by rotating the relevant gondola. At least two rings of ventilation holes are formed in the intermediate portion of each double cigarette as the gondola is rotated about its axis. The forming of the rings of ventilation holes comprises directing a pulsed laser beam along the conveyor axis, splitting the beam and directing the resulting beams divergently to concurrently impinge upon and perforate the intermediate portions of widely separated double cigarettes.

9 Claims, 2 Drawing Sheets

METHOD AND MACHINE FOR PRODUCING VENTILATED CIGARETTES

BACKGROUND OF THE INVENTION

The present invention relates to a method of producing ventilated cigarettes.

So-called "ventilated" cigarettes are produced using perforating devices normally forming part of a filter assembly machine, and the perforating "tool" of which consists of a focused laser beam.

On filter assembly machines of the type described, for example, in British patent n. 2,241,866, filter-tipped cigarettes are produced from a succession of first tobacco items consisting of double cigarette portions which, traveling transversely through a first cutting station along a path defined by the filter assembly machine, are each cut into two single portions to form a first and second orderly succession arranged side by side and parallel to each other. At a rolling station along the aforementioned path, each cigarette portion in one of the two successions is connected to a corresponding portion in the other succession to form a second tobacco item hereinafter referred to as a "double cigarette", and each of which consists of two cigarette portions separated by a double filter connected integral with the two cigarette portions by a connecting band, the central portion of which encloses the double filter, and the end portions of which each enclose one end of a respective cigarette portion.

According to the above British patent, once formed, the double cigarettes are fed successively through a second cutting station where they are cut transversely in half to form two successions of third tobacco items consisting of oppositely oriented single cigarettes. That is, downstream from the cutting station, the single cigarettes in each pair formed by cutting a respective double cigarette are arranged with their filters facing and substantially contacting each other.

Patent DE-41 08 166 relates to a filter assembly machine presenting a perforating station where the double cigarettes are rolled about their axis and simultaneously perforated with ventilation holes by a laser device designed to emit pairs of pulsating focused laser beams.

Such a method presents serious drawbacks due to the rolling operation which, if harmful to single cigarettes, is even more so when applied to double cigarettes which, on account of their length, are subject not only to tobacco fallout but also to breakage.

SUMMARY OF TEE INVENTION

It is an object of the present invention to provide a straightforward, relatively low-cost method of perforating double cigarettes, and which provides for overcoming the aforementioned drawbacks.

According to the present invention, there is provided a method of producing ventilated cigarettes, the method comprising the steps of forming a succession of double cigarettes, each comprising two cigarette portions and an intermediate double filter joined by an intermediate connecting band; feeding the double cigarettes crosswise to their axis through a perforating station; rotating each double cigarette about its axis at the perforating station; forming at least two rings of ventilation holes in each double cigarette as it is rotated about its axis; and cutting each double cigarette between the two rings of holes to form two ventilated cigarettes; characterized in that each double cigarette is rotated by supporting a first end of the double cigarette via supporting means rotating about said axis, and by engaging a second end of the double cigarette via rest means fixed in relation to said axis, so as to leave an intermediate portion of the double cigarette free and accessible for forming said at least two rings of holes in each double cigarette.

The present invention also relates to a machine for forming ventilated cigarettes.

According to the present invention, there is provided a machine for forming ventilated cigarettes, the machine comprising conveyor means for feeding a succession of double cigarettes crosswise to their axis along a given path, each double cigarette comprising two cigarette portions and an intermediate double filter joined by an intermediate connecting band; a perforating station located along said path and comprising drive means for rotating each double cigarette about its axis, and perforating means for forming at least two rings of ventilation holes in each double cigarette; and a cutting station located along said path and downstream from the perforating station, for cutting each double cigarette between the two rings of holes to form two ventilated cigarettes; characterized in that, for each double cigarette, said drive means comprise supporting means rotating about said axis and for engaging a first end of the double cigarette; and rest means fixed in relation to said axis and for engaging a second end of the double cigarette; said rotary supporting means and said rest means being so positioned in relation to each other as to leave an intermediate portion of the double cigarette free and accessible by said perforating means.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
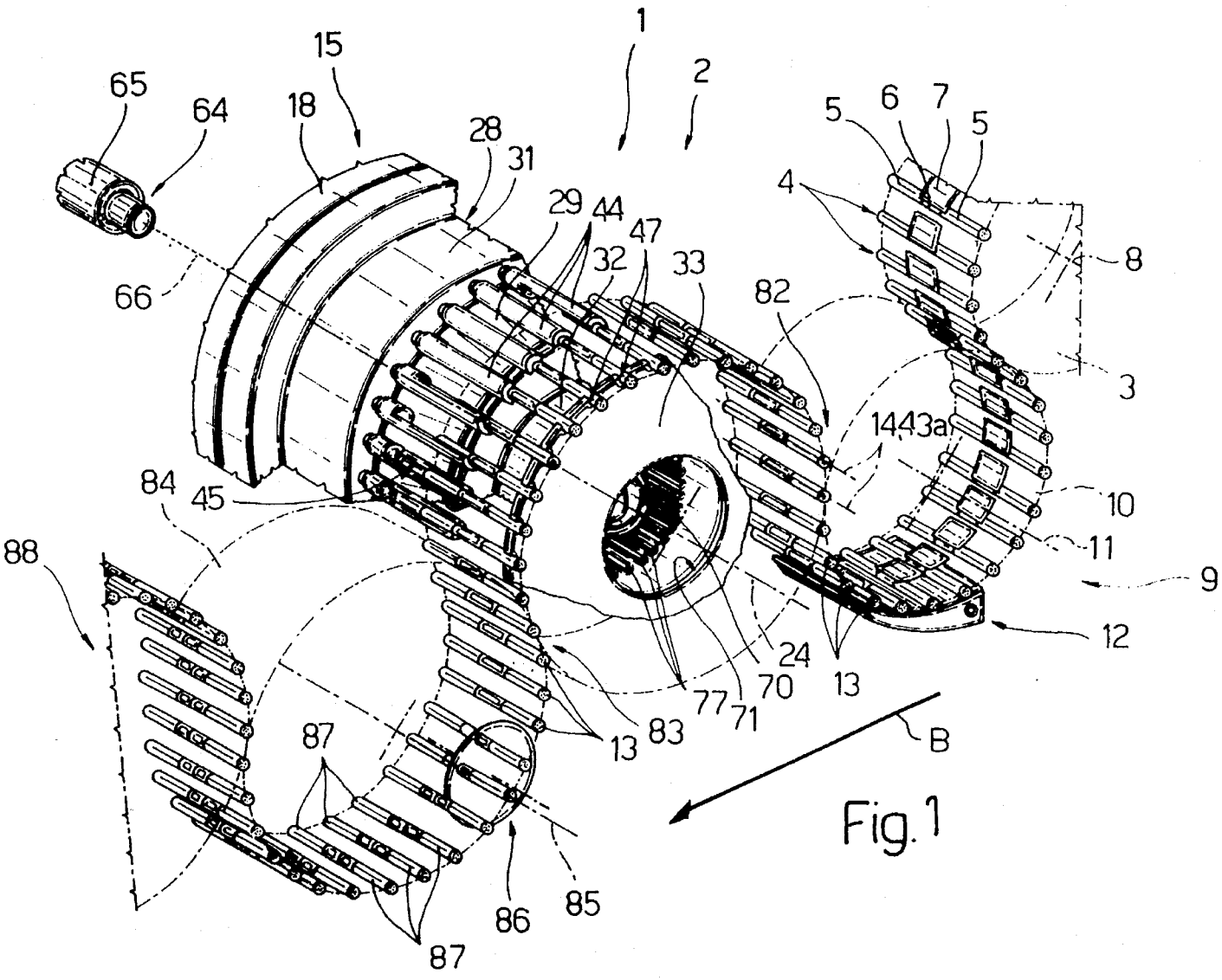
FIG. 1 shows a schematic view in perspective, with parts removed for clarity, of a preferred embodiment of the machine according to the present invention.

Number 1 in FIG. 1 indicates a filter assembly machine, the intermediate portion 2 of which comprises an input roller 3 for receiving, from known devices (not shown), a succession of groups 4, each comprising two cigarette portions 5 and a double filter 6 interposed between portions 5, and a succession of bands 7 for integrally connecting portions 5 and double filter 6 of a respective group 4.

As it rotates about its axis 8, roller 3 provides for feeding groups 4 and bands 7 crosswise to their longitudinal axis and along an initial portion of a path B extending along the whole of machine 1, and for transferring groups 4 and bands 7 to a finishing unit 9 comprising a roller 10 parallel to roller 3 and rotating at constant angular speed about its axis 11 and in the opposite direction to roller 3. Unit 9 also comprises a rolling unit 12 for successively receiving groups 4 and bands 7; for rolling each band 7 about respective double filter 6 and the end portions of respective cigarette portions 5 facing double filter 6, to form a double cigarette 13; and for feeding double cigarettes 13, crosswise to their longitudinal axis 14, to a perforating station located along path B and defined by a perforating unit 15 for forming a ring of ventilation holes 16 (FIG. 2) in the end portions of each band 7 surrounding the respective ends of a respective cigarette portion 5, to form a succession of ventilated double cigarettes 13.

Figure 2:
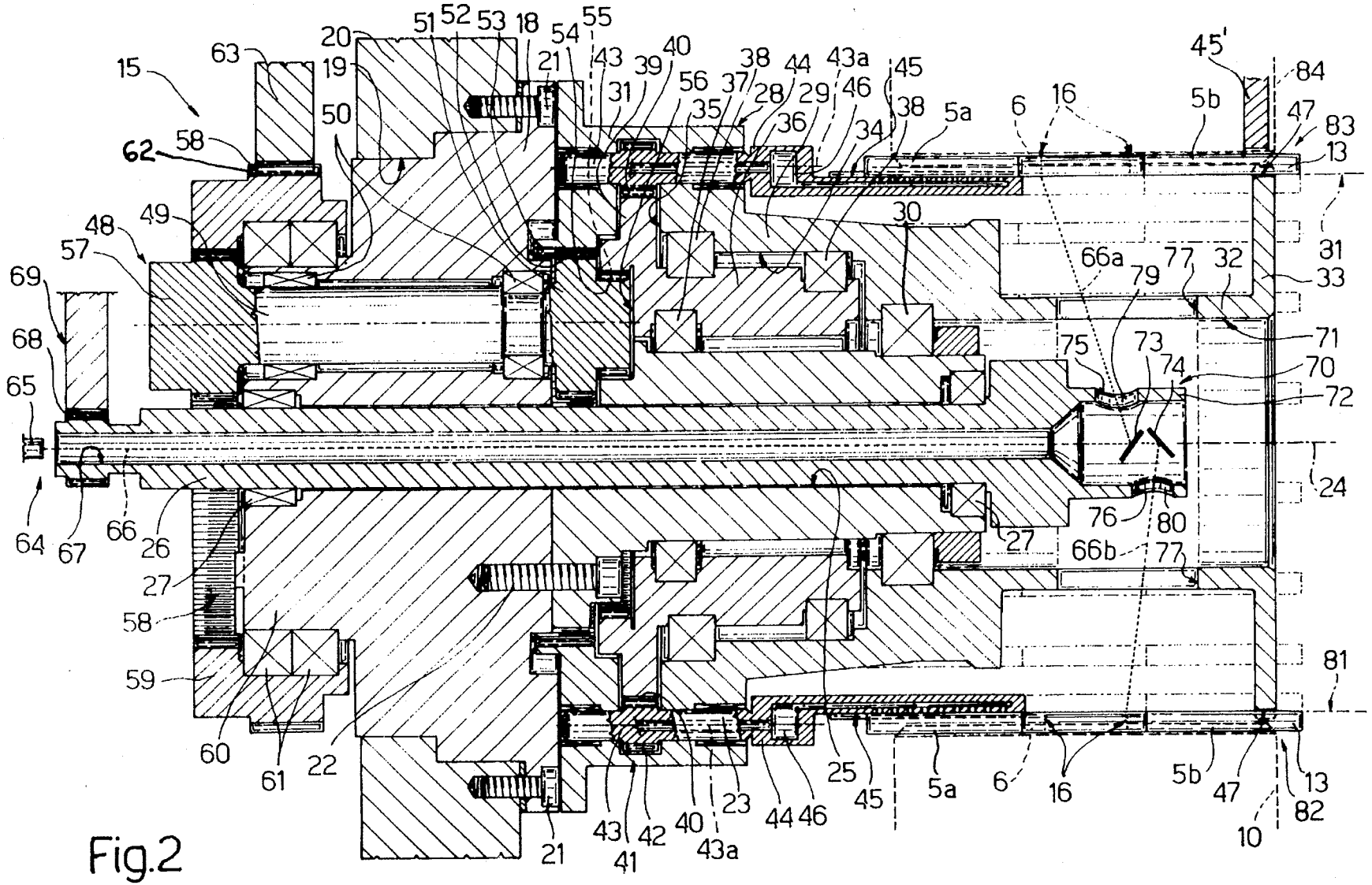
FIG. 2 shows a larger-scale axial section, with parts removed for clarity, of a detail of the FIG. 1 machine.

As shown in FIG. 2, unit 15 comprises a substantially cylindrical drum 18 fitted through a hole 19 in wall 20 of machine 1, and fitted to wall 20 by means of screws 21. Drum 18 is fitted, by means of screws 22, with an appendix 23 presenting an axis 24 coaxial with drum 18; and an axial through hole 25 is formed through appendix 23 and drum 18, and houses a tubular shaft 26 supported for rotation inside hole 25 via the interposition of bearings 27.

Appendix 23 supports for rotation a drum 28 which comprises a tubular intermediate bell 29 connected in rotary manner to appendix 23 via the interposition of a bearing 30, and presenting, at a first end, a flange 31 facing drum 18, and, at a second end, a tubular axial appendix 32 projecting beyond the free end of appendix 23 and presenting, on its own free end, an annular flange 33. Bell 29 and flange 31 present an inner cavity 34 coaxial with axis 24, facing drum 18, and in turn presenting an inner annular groove 35 extending inside flange 31. Cavity 34 houses a bush 36 fitted in rotary manner to appendix 23 via the interposition of a bearing 37, and to bell 29 via the interposition of bearings 38, and which, on the side facing drum 18, presents a flange 39 partially engaging groove 35 and presenting external teeth 40.

Teeth 40 are the sun teeth of an epicyclic drive 41 comprising a number of planetary gears 42 meshing with teeth 40 and fitted to respective shafts 43 in turn fitted in rotary manner to flange 31 so as to rotate about respective axes 43*a*, and fitted axially through flange 31 and groove 35. On the end projecting from flange 31 towards bell 29, each shaft 43 is fitted integral with a gondola 44 extending parallel to axis 24 and outside bell 29, and which defines a seat 45 for receiving and retaining, by means of a known suction device 46, a portion 5*a* of a double cigarette 13, the double filter 6 of which projects entirely outwards of gondola 44 and bell 29, and the other portion 5*b* of which rests inside a respective seat 47 formed in the periphery of flange 33 and coaxial with respective seat 45.

Drum 28 and drive 41 are rotated about axis 24 by a drive device 48 comprising a shaft 49 fitted, parallel to axis 24, through drum 18 and via the interposition of bearings 50. Device 48 also comprises a pinion 51 housed inside flange 31 and presenting external teeth 52 meshing with a ring gear 53 fitted to flange 31 and formed on the inner surface of cavity 34, and further teeth 54 smaller in diameter than teeth 52 and meshing with a ring gear 55 formed on the inner surface of an axial cavity 56 in turn formed on the surface of bush 36 facing drum 18.

At the opposite end to that fitted with pinion 51, shaft 49 is fitted with a further pinion 57 meshing with a ring gear 58 coaxial with axis 24 and formed on the inner surface of a ring 59 supported for rotation on a tubular appendix 60 of drum 18 via the interposition of bearings 61. On the outer surface of ring 59, there is formed a ring gear 62 meshing with a powered gear 63.

Shaft 26 forms part of a laser perforating unit 64 in turn comprising a laser source 65—in the example shown, a pulsating laser source for emitting a beam 66 along an axial hole 67 formed in shaft 26 and coaxial with axis 24. On the end facing source 65, shaft 26 presents an outer ring gear 68 meshing with the output drive 69 of a motor (not shown) for rotating shaft 26 about axis 24.

At the opposite end to that fitted with ring gear 68, shaft 26 presents a reflecting head 70 housed inside a chamber 71 defined laterally by appendix 32 and closed at one end by the free end of appendix 23. Head 70 is defined laterally by a cylindrical wall 72 integral with shaft 26, and houses a semitransparent mirror 73 and a total reflection mirror 74. Mirrors 73 and 74 are located in series with each other along axis 24 so as to divide beam 66 into two beams 66*a*, 66*b*, and are so inclined as to direct beams 66*a*, 66*b* through respective diametrically-opposite, axially-offset radial holes 75, 76 formed through wall 72 and which are aligned with respective axial slots 77 formed through appendix 32 at each gondola 44. Holes 75, 76 are fitted inside with respective lenses 79, 80 for focusing beams 66*a*, 66*b* at respective points of a cylindrical surface 81 tangent to seats 45 and 47.

Holes 16 are formed in double cigarettes 13 as these travel between a loading station 82, where double cigarettes 13 are loaded on to unit 15, and an unloading station 83, where double cigarettes 13 are unloaded on to a roller 84 tangent to unit 15 and rotating about its axis 85 in the same direction as roller 10. Roller 84 provides for feeding double cigarettes 13 through a cutting station 86 where they are cut in half at respective double filters 6, and more specifically between the two rings of holes 16, to form two ventilated filter-tipped cigarettes 87 which are then transferred to the output portion 88 of machine 1.

In actual use, drive device 48 rotates drum 28 at an angular speed V1, and so operates drive 41 as to rotate gondolas 44 about respective axes 43*a* at such an angular speed V2 that each gondola 44 makes at least one complete turn about axis 43*a*in the time taken for it to travel along a perforating arc extending between stations 82 and 83. At the same time, drive 69 rotates head 70 about axis 24 at such an angular speed V3 that head 70 makes n number of complete turns, equal to the number of holes 16 in each ring, in the time taken by each gondola 44 to travel along said perforating arc. Finally, laser source 65 is pulsated in such a manner as to emit a laser pulse each time hole 75, 76 is aligned with slot 77, so that, for each pulse, two holes 16, each forming part of a respective ring, are formed in the portions of two double cigarettes 13 projecting from respective gondolas 44 and facing respective slots 77. In the example shown, said holes are formed through band 7 of said two double cigarettes 13. As they travel along said perforating arc, double cigarettes 13 supported in seats 45 and 47 may be flanked by a fixed outer surface 45' coaxial with roller 28 (FIG. 2).

Perforating unit 15, by virtue of being located along path B, immediately upstream from cutting station 86, therefore provides not only for forming the rings of holes 16 in double cigarettes 13, but also for rotating double cigarettes 13 about respective axes 14 with no rolling action required; which rotation is achieved in straightforward, low-cost manner, using, for each double cigarette 13, a single rotary support defined by gondola 44 on one side, and a fixed support defined by flange 33 on the other.

We claim:

1. A method of producing ventilated cigarettes the method comprising the steps of forming a succession of double cigarettes, each comprising two cigarette portions and an intermediate double filter joined by an intermediate connecting band; feeding the double cigarettes crosswise to their axis to respective supporting means on a rotary conveyor having an axis, the supporting means comprising rotatable supporting means in turn comprising a gondola normally facing outward in relation to the conveyor and rotatable about its axis, and fixed supporting means including rest means fixed in relation to the conveyor; each double cigarette being arranged in engagement with the relevant supporting means so that a first end portion of said double cigarette laterally engages said rotatable gondola, a second end portion of said double cigarette laterally engages said rest means, and an intermediate portion of said double cigarette; including said intermediate double filter, is free; advancing said conveyor to feed the double cigarettes through a perforating station; rotating each double cigarette about its axis at the perforating station by rotating the respective gondola; forming at least two rings of ventilation holes in each double cigarette and at said intermediate portion as said respective gondola is rotated about its axis; and cutting each double cigarette between the two rings of holes to form two ventilated cigarettes, said forming of said rings of ventilation holes comprising directing a pulsed laser beam along said conveyor axis, splitting said beam and directing the resulting beams divergently to concurrently impinge upon and perforate the intermediate portions of widely separated double cigarettes.

2. A method as claimed in claim 1, wherein said two rings of holes are formed in each double cigarette by means of a laser source, the laser beam of which is divided into two laser beams, each relative to a respective said ring of holes.

3. A machine for forming ventilated cigarettes, the machine comprising conveyor means for feeding a succession of double cigarettes crosswise to their axis along a given path (B), each double cigarette comprising two cigarette portions and an intermediate double filter joined by an intermediate connecting band; a perforating station located along said path (B) and comprising rotary conveying means having a conveyor axis, drive means for rotating each double cigarette about its axis, and perforating means for forming at least two rings of ventilation holes in each double cigarette, said perforating station including laser means for producing a laser beam and for directing said laser beam along said axis of said conveying means, means for splitting said laser beam into multiple beams, and means for directing said beams divergently to concurrently impinge upon and perforate the intermediate portions of widely separated double cigarettes; and a cutting station located along said path and downstream from the perforating station, for cutting each double cigarette between the two rings of holes to form two ventilated cigarettes; wherein, for each double cigarette, said drive means comprise rotatable supporting means in turn comprising a gondola normally facing outward in relation to the conveyor and rotatable about its axis and for laterally engaging a first end portion of the double cigarette; and fixed supporting means including rest means fixed in relation to said axis and for laterally engaging a second end portion of the double cigarette; said rotatable supporting means and said fixed supporting means being so positioned in relation to each other as to leave an intermediate portion of the double cigarette, including said intermediate double filter, free and accessible by said perforating means.

4. A machine as claimed in claim 3, wherein said rotary conveying means comprise a drum mounted for rotation about said conveyor axis and located at said perforating station; said drum being fitted with said rotatable and fixed supporting means; said rotatable supporting means being each rotatable in relation to said drum about its respective said axis parallel to said conveyor and with said drum about said conveyor axis; and said fixed supporting means being rotatable with said drum about said conveyor axis.

5. A machine as claimed in claim 3, wherein each said gondola defines a first seat coaxial with its respective said axis and for at least partly receiving a first of said two end portions of a respective said double cigarette; said rest means defining, for each said first seat, a second seat coaxial with a respective first seat and for at least partly receiving a second of said two end portions of a respective said double cigarette.

6. A machine as claimed in claim 4, wherein said perforating means are laser perforating means.

7. A machine as claimed in claim 6, wherein said laser perforating means comprise a laser source for emitting a laser beam along said conveyor axis; and dividing means for dividing said laser beam into two secondary laser beams and directing the secondary laser beams in substantially radial directions in relation to said conveyor axis.

8. A machine as claimed in claim 7, wherein said dividing means comprise two separate reflecting devices aligned along said conveyor axis.

9. A machine as claimed in claim 8, wherein one of said reflecting devices comprises a semitransparent mirror, and the other of said reflecting devices comprises a total reflection mirror.

* * * * *